US006367376B1

(12) United States Patent
Bobren

(10) Patent No.: US 6,367,376 B1
(45) Date of Patent: Apr. 9, 2002

(54) STRAPPING MACHINE WITH RESTRICTION DEVICE

(75) Inventor: Allen J. Bobren, Streamwood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/596,455

(22) Filed: Jun. 19, 2000

(51) Int. Cl.[7] ..... B30B 9/30

(52) U.S. Cl. ..... 100/8; 53/588; 53/589; 53/582; 100/26; 100/29; 100/32; 100/33 PB

(58) Field of Search ..... 53/588, 589, 582; 100/8, 26, 29, 32, 33 PB; 226/25

(56) References Cited

U.S. PATENT DOCUMENTS 5,299,407 A * 4/1994 Schuttler et al. ..... 53/399
5,459,977 A * 10/1995 Haberstroh ..... 53/399
5,509,594 A * 4/1996 Maggioni ..... 226/35
5,640,899 A 6/1997 Bell et al. ..... 100/2
5,657,612 A 8/1997 Renz et al. ..... 53/399
5,718,167 A 2/1998 Renz et al. ..... 100/29
5,746,882 A 5/1998 Bell et al. ..... 156/580
5,778,643 A * 7/1998 Tacchini ..... 53/589
6,035,774 A * 3/2000 Fischer ..... 100/32
6,039,286 A 3/2000 Abrams et al. ..... 242/564.4

* cited by examiner

*Primary Examiner*—Rinaldi I. Rada
*Assistant Examiner*—Thanh Truong
(74) *Attorney, Agent, or Firm*—Donald J. Breh; Mark W. Croll; Lisa M. Soltis

(57) ABSTRACT

A strapping machine is provided with a restriction device that helps prevent strapping material, remaining after a break in the material, from being drawn, by gravity or inertia, into the strapping machine slap box. The restriction device also assists in the orderly movement of strapping material through the strapping machine, by being adjustable, by either strap tension or weight, to widen or restrict the strap path as needed.

7 Claims, 5 Drawing Sheets

STRAPPING MACHINE WITH RESTRICTION DEVICE

FIELD OF THE INVENTION

The present invention concerns a novel restriction device for a strapping machine which prevents strapping material, which has either failed to feed or which has broken, from becoming loose and falling into the slack box of a strapping machine.

BACKGROUND OF THE INVENTION

Strapping machines comprise a number of elements that allow for a strap to be fed from a reel to a strapping head and then onto an object to be strapped. Within the strapping machine the strapping material must be fed through a number of elements that allow the strapping material to travel quickly, efficiently, and accurately towards an object to be strapped. In the operation of strapping machines the strap is first propelled in a forward direction towards the item to be strapped and then the strap is pulled around the item and tightened. Means are provided to reverse the direction of strap travel so that strap may be tightened about the object prior to cutting the strap and so that cutting and securing strap can be accomplished with little waste of material. Strap pulled back into the machine during the tightening process is subsequently released, within the strap path, for further strapping. However, because strap can double up when released, which may result in a restriction of its movement, use of these complex strapping machines is often times impeded by a blockage of loose strap.

Because of the nature of the strapping material, and the need for the material to move rapidly through the strapping machine, no single element of these machines generally holds the loose end of the strapping material within the strapping machine. In some present strapping machines, upon the breaking of an end of the strapping material, the leading end of the strap which is left in the strapping machine is subjected to the pull of gravity and inertia during take-up and little, if any, restraint. The strap end, therefore, often falls or coasts from the guiding members of the machine into the slack box of the machine. This action is known as "suck-back" by users of strapping machines. When suck-back occurs, the end of the reel must be retrieved and the strapping machine must be re-threaded. This process is time consuming and causes delays in the strapping process.

Previously, a fixed type of restrictor has been tried in certain strapping machines. The fixed restrictors, which have been placed between the strap gate and the winder (or strap tensioning device) have proven to be effective in preventing suck back, but also simultaneously restrict strap, which is not broken or loose, from proceeding in the strap path after certain normal machine operations. For example, after an unwinding (a common event in a strapping cycle), strap may form a "tear drop" shaped loop. In a machine with a fixed restrictor, strap material in the shape of a tear drop may be prevented from passing through the fixed restrictor because of the inherent doubling up of the thickness of the strap in such a loop. Further, a fixed restrictor may prevent loops of strap from pulling out of the slack box and into the head, for similar reasons.

SUMMARY OF THE INVENTION

In accordance with the present invention, a strapping machine, having a strap restriction device, a winder, a strap gate, and a slack box is provided. The strap restriction device is provided with an upper guide, having a first end and a second end and a lower guide, having a first end and a second end, said first end of said lower guide being rotationally connected to said first end of said upper guide. The upper guide and the lower guide are biased apart by a spring which urges the second end of the upper guide apart from the second end of the lower guide. In a first default position, the second end of the upper guide is generally disposed, by the spring, toward the winder and the second end of the lower guide is generally disposed toward the strap gate. In the first default position, the upper and lower guides form a strapping guide between the winder and the strap gate and restrict the size of the path for the strapping material. Further, the ends of the upper and lower guide in the first default position, together, form a strap path which provides a frictional surface on which the strap may drag. In these ways the restriction device prevents strapping material from falling or coasting into the slack box.

As the guides are spring biased the movement of strap, respectively, beneath or above the lower and upper guide, can change the position of the guides depending on the tension and force applied to the guides by the strap. The lower guide, when forced upward by strap, provides less of a restriction for the strap to travel through allowing for quicker strap speeds. When the upper guide is forced downward by strap, the restriction device provides less restriction below the winder, allowing quicker clean up of looped material. For example, the formation of a loop of material, due to any number of causes, including the winding and subsequent unwinding of strapping material, may cause the upper guide to be forced downward. When the upper guide is forced downward less restriction occurs for strap passage between the guide and the winder, allowing the loop of strap to be more quickly pulled out of the machine. Similarly, a loop between the lower guide and the strap gate is more quickly removed when the guide is forced upward by the strap.

In one embodiment of the present invention the lower guide is divided into two sections along its longitudinal axis and the upper guide is rotationally set between the two section of the lower guide and attached to a strapping machine. The lower guide sections and the upper guide are biased apart at their second ends by a spring such that the upper guide is disposed upward and the two sections of the lower guide are disposed downward. In this manner strap which may travel laterally along the strapping gate, may be more easily guided by the two separate parts of the lower guide.

A more detailed explanation of the invention is provided in the following description and claims and is illustrated in the accompanying drawings.

DETAILED DESCRIPTION OF THE ILLUSTRATIVE EMBODIMENT

Figure 1:
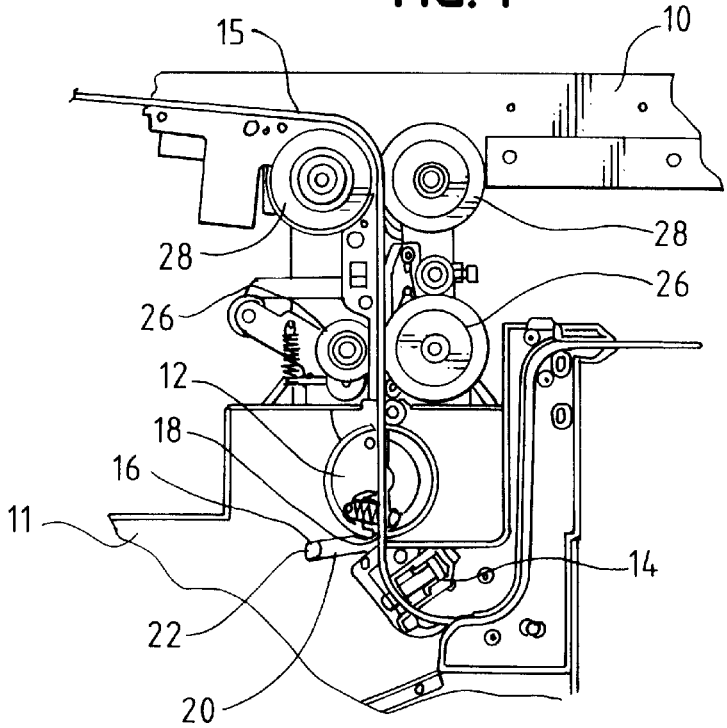
FIG. 1 is a front elevational view of a strapping machine made in accordance with the principles of the present invention, showing a restriction device in a first default position.
Figure 2:
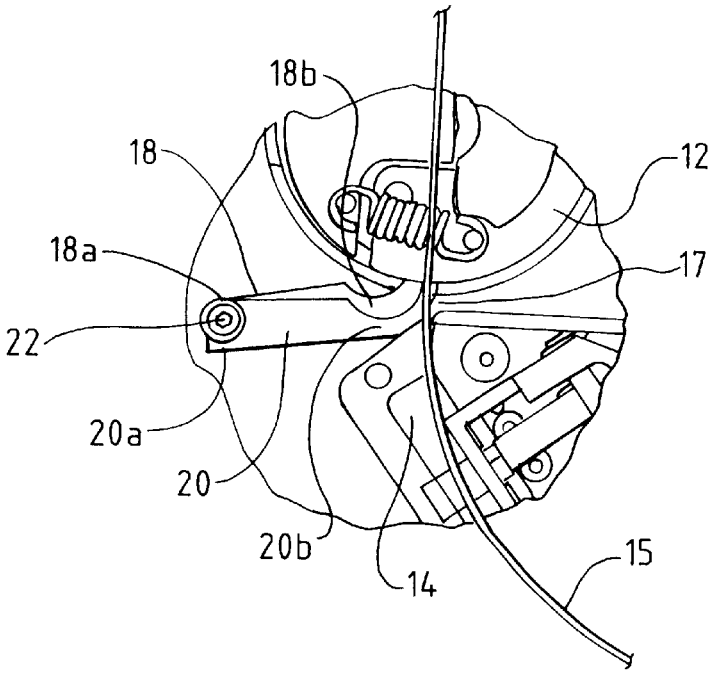
FIG. 2 is an enlarged front elevation view of the restriction device of FIG. 1.

Referring to the drawings, FIGS. 1 and 2 show a strapping machine 10 having a winder 12 and a strap gate 14 in a first strapping position with strapping material 15 being fed through strapping machine 10. A restriction device 16 comprising an upper guide 18 and a lower guide 20 is provided. Upper guide 18 and lower guide 20 are rotationally connected by pin 22 at a first end 18*a* and 20*a*, respectively, to each other and to the strapping machine 10 through wall 11. The second ends of guide 18 and 20, upper guide end 18*b* and lower guide end 20*b*, of restriction device 16 are biased apart by a spring (not shown). In a default, at rest position, upper guide 18 is biased upward and upper guide end 18*b* is disposed generally toward winder 12 and lower guide 20 is biased downward and lower guide end 20*b* is disposed generally toward strap gate 14. In this first default position, strapping material 15 is fed through strapping machine 10 under constant tension, putting little or no pressure on restriction device 16. As a result, the biasing spring of restriction device 16 is the prevalent force on the upper guide 18 and lower guide 20 of restriction device 16, biasing upper guide end 18*b* and lower guide end 20*b* apart and toward, respectively winder 12 and strap gate 14. Restriction device 16 thereby closes the gap 17 between winder 12 and strap gate 14 so that strapping material 15 proceeds from strap gate 14 through to winder 18 utilizing guide ends 18*b* and 20*b* as additional guidance between these elements.

Figure 3:
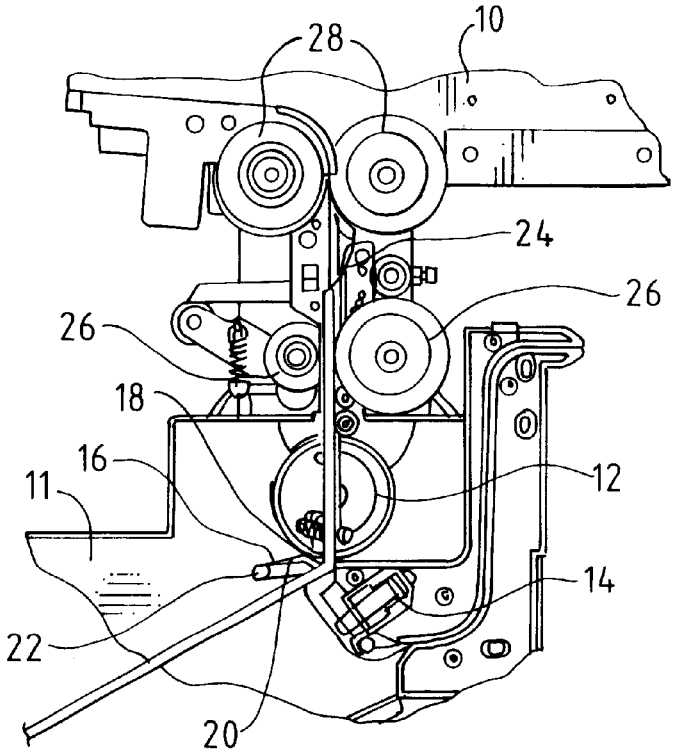
FIG. 3 is an elevational view of the strapping machine of FIG. 1, showing the restriction device in a second position.
Figure 4:
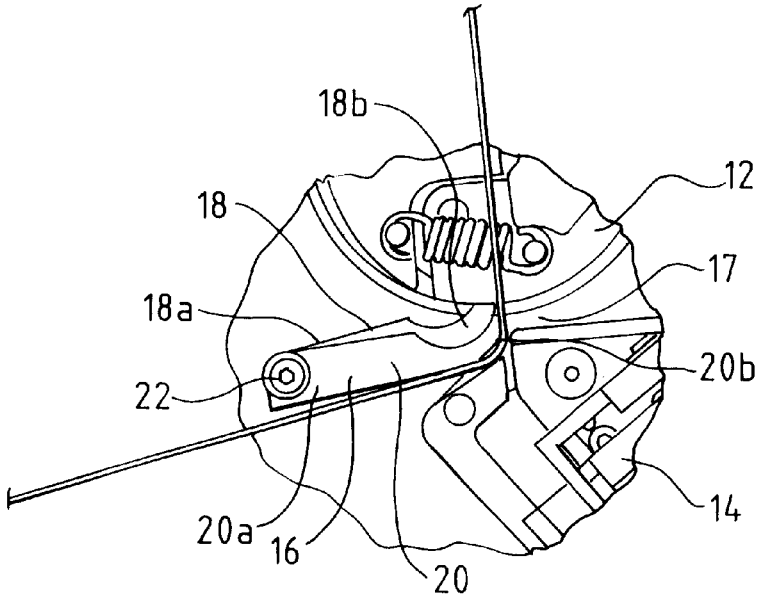
FIG. 4 is an enlarged front elevational view of the restriction device of FIG. 3.

Referring now to FIGS. 3 and 4, strapping machine 10 is shown with the leading edge 24 of strapping material 15 in a position between feed wheels 26 and tension wheels 28. Restriction device 16, in its first default position, as shown in FIGS. 1 and 2, has lower guide 20 and upper guide 16 biased apart, filling gap 17. Lower guide 20*b* of restriction 16 in conjunction with strap gate 14 provide a drag on strapping material 15 such that the leading edge 24 of the strapping material is stopped from slipping or coasting through feed wheels 26 down to the slack box (not shown). Such a slip, also known as a "suck back" is thus prevented by restriction device 16 of the present invention. Thus, in FIGS. 1 through 4, the default position of restriction device 16 is shown to provide a path for strapping material 15 proceeding normally through the strapping machine 10 and to provide a means for stopping the slippage of strapping material 15 into the slack box. Suck back, which requires that the strapping process cease and that strapping material 15 be re-threaded into strapping machine 110, is thus generally eliminated.

The improvement over fixed restriction devices of the prior art is shown in the ability of restriction device 16 to provide guidance for strapping material 15 and prevent suck back, while allowing the flexibility of allowing feeding of strapping material 15 after unwinding and when an excess of slack strapping material has accumulated in the slack box, both common events. In these conditions, as explained below, lower guide 20 may be pushed upward and upper guide 18 may be pushed downward, by the force of strapping material 15, to open gap 17 as needed to alleviate strap drag that causes jams.

Figure 5:
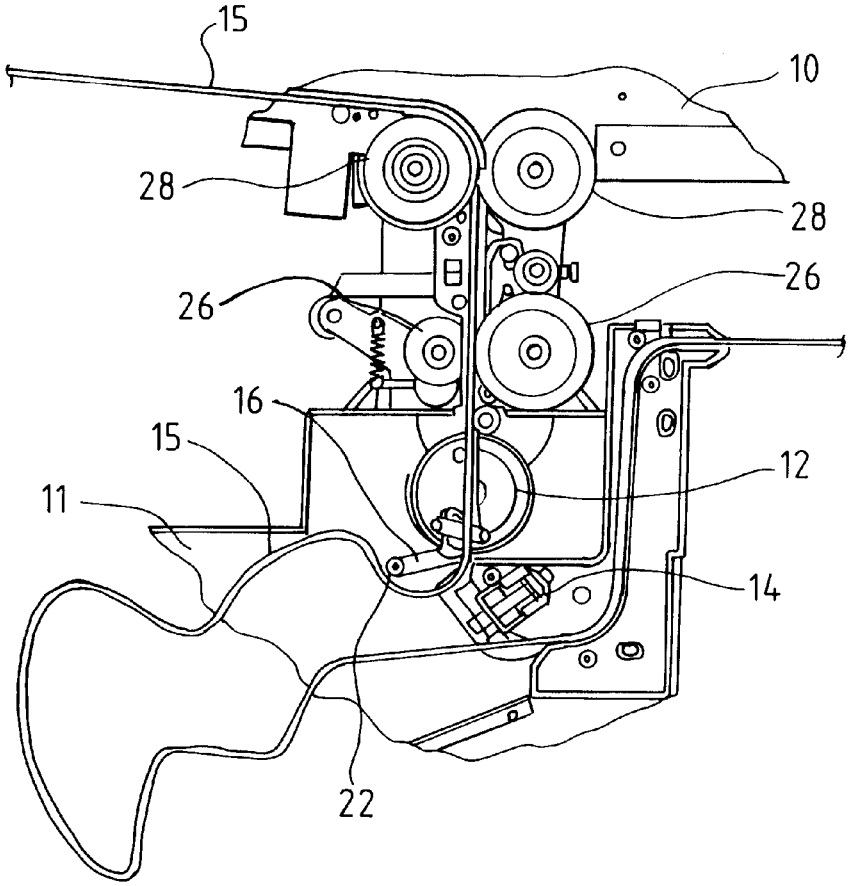
FIG. 5 is an elevational view of the strapping machine of FIG. 1, showing the restriction device in a third position.
Figure 6:
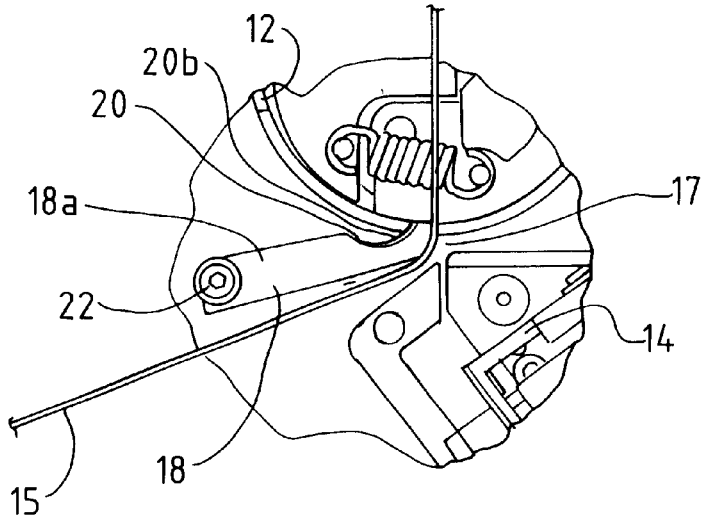
FIG. 6 is an enlarged front elevational view of the restriction device of FIG. 5.

Referring now to FIGS. 5 and 6, strapping machine 10 is shown having an excess of strapping material 15 in a slack box (not shown) and below and about strap gate 14 and winder 12. In such situations, strapping material 15 is not fed through strapping machine 10 under constant tension. Strapping material 15 may tend to push upward on lower guide end 20*b*, forcing the lower guide to be pushed upward providing a larger gap 17, reducing feed force requirements and providing a means to eliminate the slack without entanglement of the strapping material 15.

Figure 7:
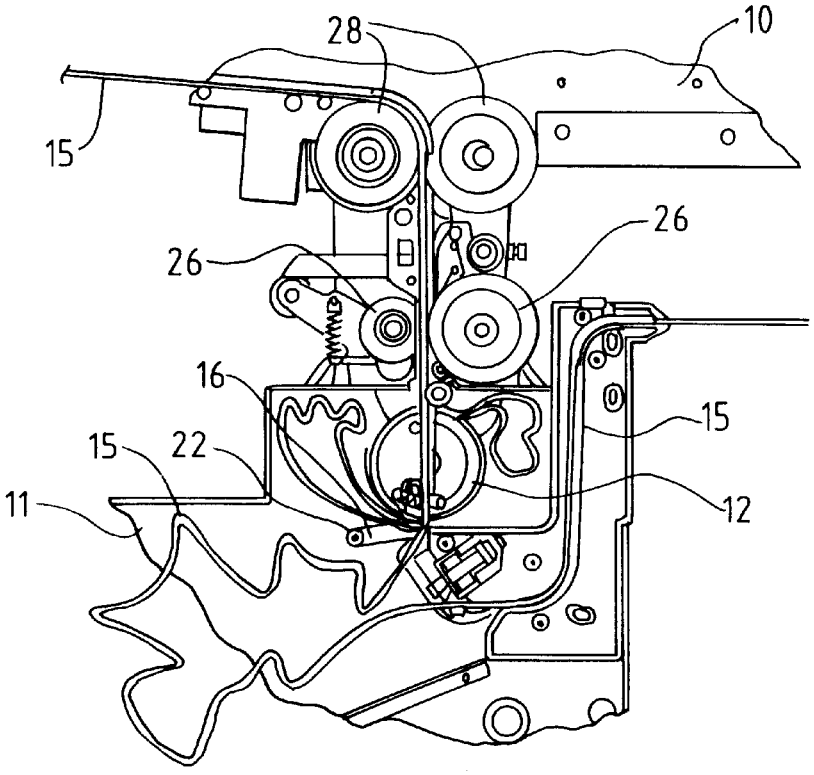
FIG. 7 is an elevational view of the strapping machine of FIG. 1, showing the restriction device in a fourth position.
Figure 8:
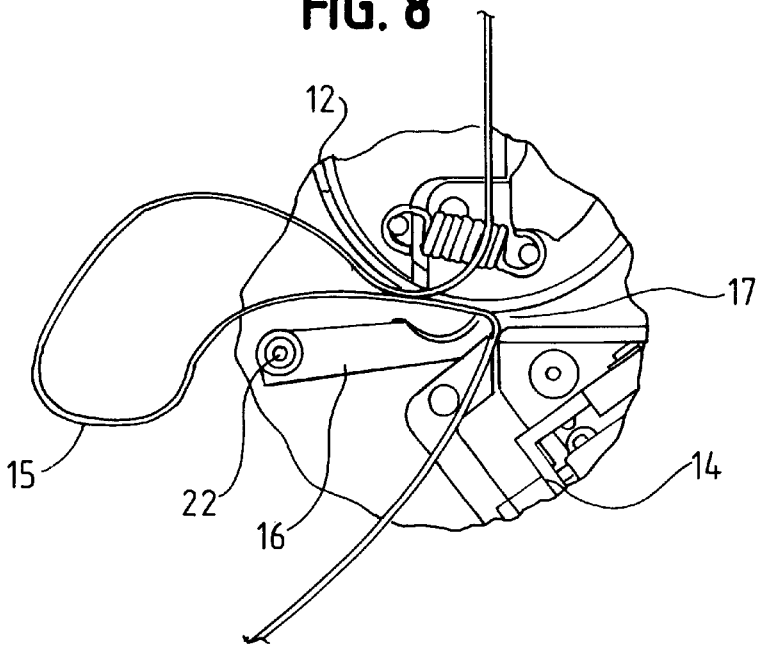
FIG. 8 is an enlarged front elevational view of the restriction device of FIG. 7.

In another situation, as illustrated in FIGS. 7 and 8, after strapping material has been fed through the head (not shown) of strapping machine 10, and placed around an object to be strapped, the tension wheels 28 of the strapping machine 10, in association with winder 12, cause the free end of the loop of strapping material 15, around the object to be strapped, to be pulled into strapping machine 10 tightening the strapping material 15 about the object to be strapped. After the ends of the strapping material are fastened together, in a manner known in the art, the strapping material 15 is cut, the winder 12 unwinds to allow the rewound material to subsequently be used to strap the next item to be strapped. Feed wheels 26 begin to feed the strapping material again towards the head (not shown). Concurrently, new strapping material 15 has continued to be fed towards strap gate 14 and has collected in the slack box (not shown). Loops of strapping material 15, as shown in FIG. 8, are thereby formed above and below restriction device 16. The presence of these loops, or "tear drops", of strapping material force upper guide 18 to be disposed toward the lower guide widening gap 17. In this manner restriction device 16 has its lowest profile allowing for the freer flow of strapping material 15 such that local jamming incidents are reduced or generally eliminated.

Figure 9:
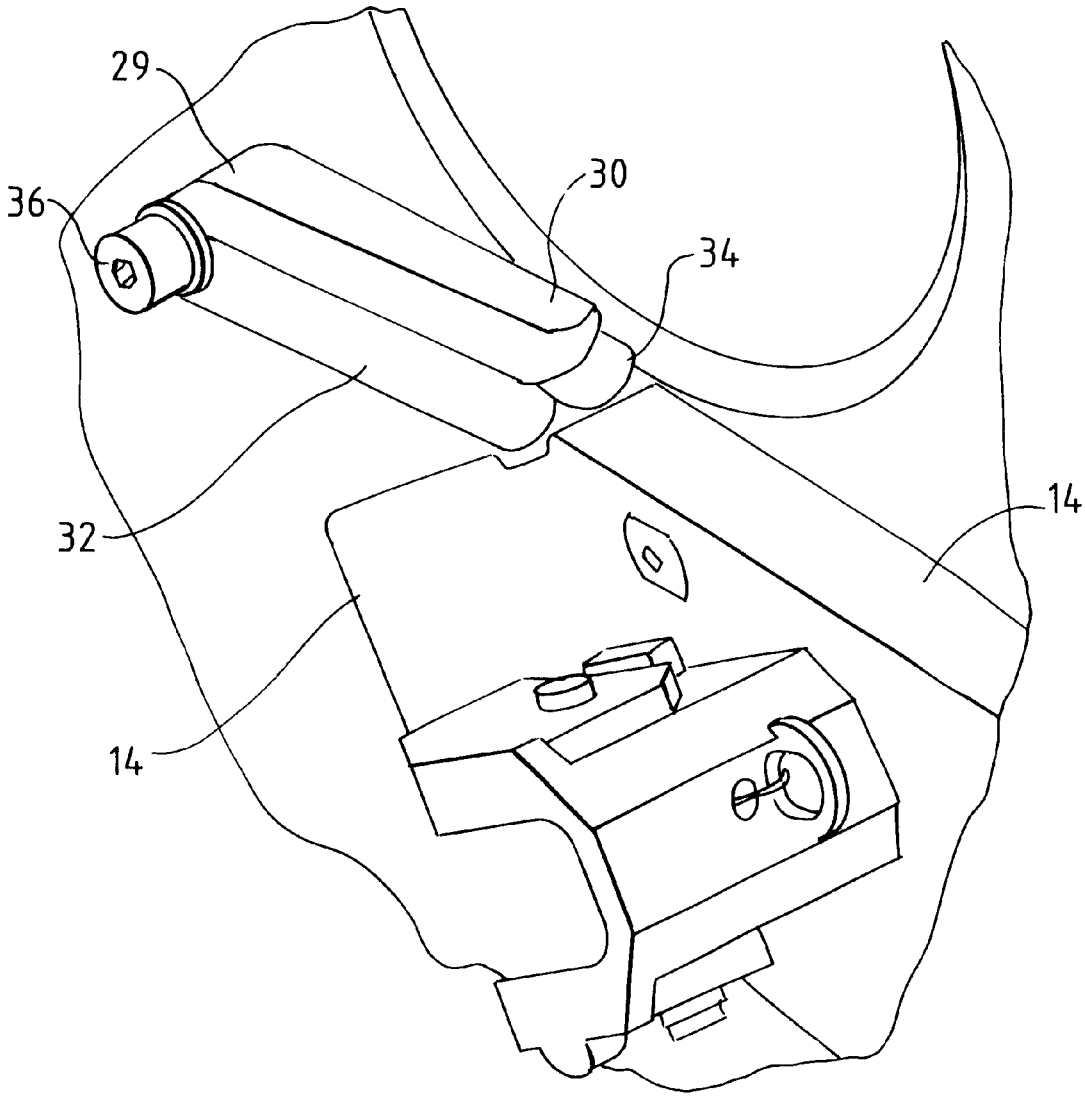
FIG. 9 is a perspective view of another embodiment of the restriction device of the present invention.

It is to be understood that variations of the shape and size of restriction device 16 may be made without departing from the novel scope of the present invention. For example, in the preferred embodiment of the present invention, shown in FIG. 9, a restriction device 29 having a three guiding members, one upper guide 30, for engagement with winder 12 sandwiched between two lower guides 32 and 34, for engagement with strap gate 14 are shown, rotationally engaged together, at a first end, by a pin 36 and biased apart by a spring (not shown), in a manner similar to that described above. The use of two lower guides 32 and 34 allows for guidance under conditions of wide lateral movements of strapping material through strap gate 14.

Although illustrative embodiments of the invention have been shown and described, it is to be understood that various modifications and substitutions may be made by those skilled in the art without departing from the novel spirit and scope of the invention.

What is claimed is:

1. A strapping machine, having a restriction device, comprising:

a winder;

a strap gate, disposed operationally apart from said winder;

a slack box;

an upper guide, having a first end and a second end;

a lower guide, having a first end and a second end, said first end of said lower guide being rotationally connected to said first end of said upper guide;

said upper guide and said lower guide being biased apart such that said second end of said upper guide is urged apart from said second end of said lower guide, forming a strapping guide between said winder and said strap gate, said second end of said upper guide being disposed toward said winder and said second end of said lower guide being disposed toward said strap gate, in a first default position.

2. The restriction device of claim 1, wherein said strapping guide formed by said upper guide and said lower guide is disposed to restrict the size of the gap between said strap gate and said winder to prevent strapping material from falling or coasting into said slack box.

3. The restriction device of claim 1, wherein said strapping guide formed by said second end of said upper guide and said second end of said lower guide define a frictional surface to slow falling or coasting strap within said strapping machine.

4. The restriction device of claim 1, wherein said lower guide may be forced up or upper guide forced down, in the presence of strap forces, to provide reduced restriction in said strapping machine to prevent strap jamming.

5. The restriction device of claim 1, wherein said lower guide is comprised of two parts, said upper guide being rotationally attached between said two parts of said lower guide at said first end, and biased apart from said upper guide at said second end.

6. The restriction device of claim 1, wherein said upper guide and said lower guide are biased apart by a spring.

7. A strapping machine, having a restriction device, comprising:

a winder;

a strap gate;

a slack box;

an upper guide, having a first end and a second end;

a lower guide, having a first end and a second end, said first end of said lower guide being rotationally connected to said first end of said upper guide;

said upper guide and said lower guide being biased apart by a spring such that said second end of said upper guide is urged apart from said second end of said lower guide, forming a strapping guide between said winder and said strap gate, said second end of said upper guide being disposed toward said winder and said second end of said lower guide being disposed toward said strap gate, in a default position; and, said lower guide being disposed up in the presence of strap forces or said upper guide being disposed down in the presence of strap forces to provide reduced restriction in said strapping machine to prevent strap jamming.

* * * * *